United States Patent [19]

Garcia

[11] 4,197,358

[45] Apr. 8, 1980

[54] FLEXIBLE STATUE

[76] Inventor: James Garcia, 644 Union St., Apt. #2, Brooklyn, N.Y. 11215

[21] Appl. No.: 31,406

[22] Filed: Apr. 19, 1979

[51] Int. Cl.[2] ..... A63H 3/04

[52] U.S. Cl. ..... 428/542; D11/160; 46/32; 46/162; 428/16

[58] Field of Search ..... 428/16, 542; 46/120, 46/162, 32

[56] References Cited

U.S. PATENT DOCUMENTS

| | | | |
|---|---|---|---|
| 1,590,898 | 6/1926 | McAuley | 46/162 X |
| 1,872,544 | 8/1932 | Williams | 46/120 |
| 2,209,791 | 7/1940 | Norriss | 46/162 |
| 2,392,024 | 1/1946 | Couri | 46/157 X |
| 2,684,503 | 7/1954 | Silver | 264/254 |
| 3,057,096 | 10/1962 | Phillips | 428/16 |
| 3,668,805 | 6/1972 | Coleman | 46/151 |
| 4,091,565 | 5/1978 | Sheehan | 428/16 X |

*Primary Examiner*—Henry F. Epstein
*Attorney, Agent, or Firm*—Richard L. Miller

[57] ABSTRACT

A figurine which can be flexed into different animated positions, and including a soft wire frame imbedded inside a body of flexible material, the figurine being removably mounted on a base, and the present invention further including various garments for being removably fitted on the figurine.

1 Claim, 5 Drawing Figures

35
10
5
5
31a
13
10
36
12
13

37
38
40
39

21
29
20
29
22
23
25
19
18
24
17
25
24
23
14
11
12
17
16
13
15

14
27
28
28
26
22
14
16
30
30
31
15
31a
13
33
32
34

FLEXIBLE STATUE

BACKGROUND OF THE INVENTION

This invention relates generally to figurines such as are adjustable in stance positions.

Heretofore, statuettes have been made particularly for use by art students, wherein the same are adjustable in stance. However, such statuettes have been more diagramatically skeletal rather than realistic so as to more visably show angular relationship of limbs.

SUMMARY OF THE INVENTION

Accordingly, it is a principal object of the present invention to provide a flexible statue which is realistic in finished appearance, by having a resilient body properly contoured around a central wire frame.

Another object is to provide a flexible statue which can be clothed by garments separately provided therefor, and wherein the garments may comprise athletic uniforms for the statues when positioned in stances of athletic action that are familiar to specific sports, such as when playing baseball, swinging a golf club, running a race or the like.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF PREFERRED EMBODIMENT

Figures 1, 2, 3, 4, 5:
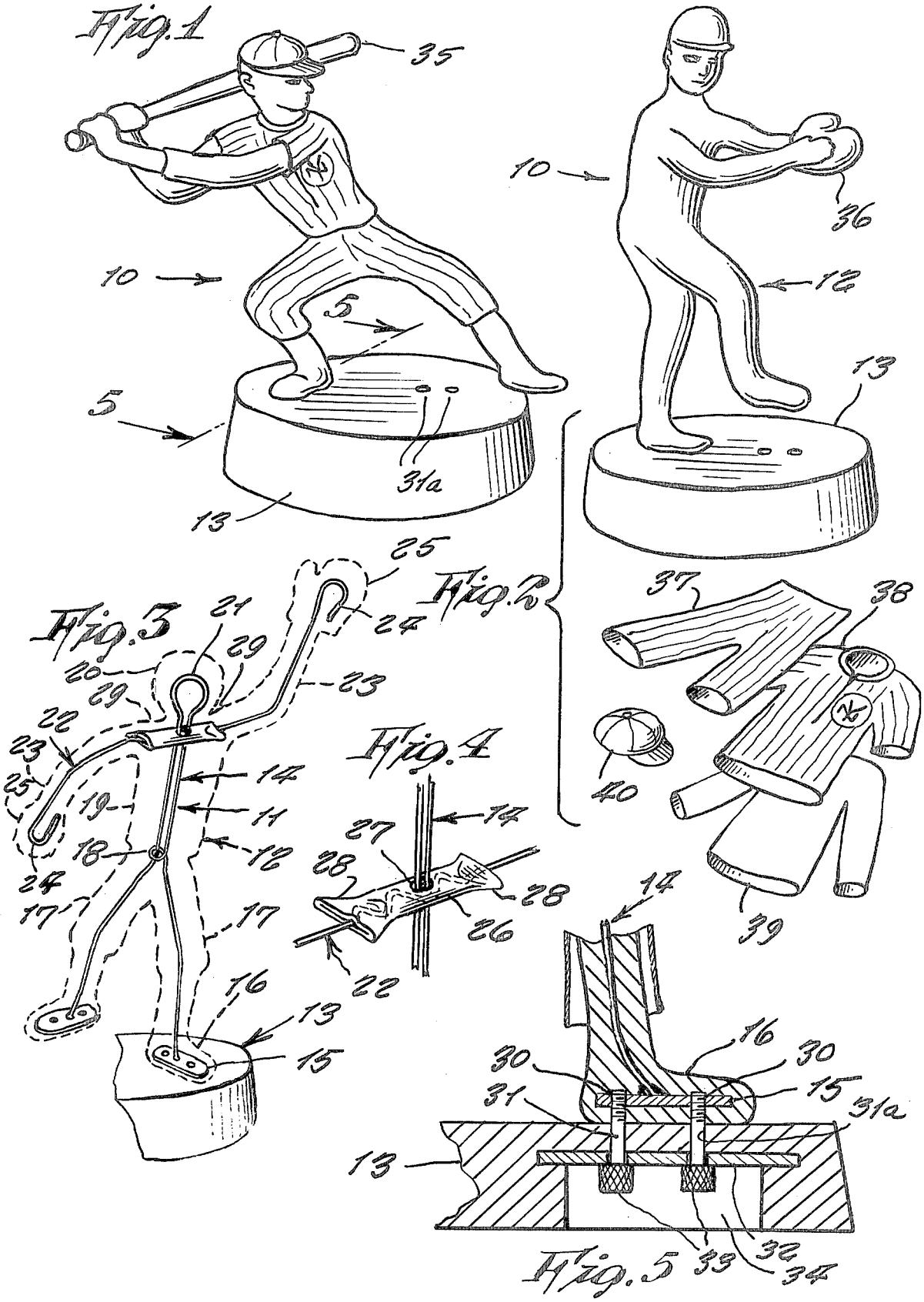
FIG. 1 is a perspective view of the figurine dressed and posed as a baseball batter.
FIG. 2 shows the figurine undressed and posed as a pitcher.
FIG. 3 is a diagram of the bendable frame inside the figurine's body.
FIG. 4 is an enlarged detail thereof.
FIG. 5 is an enlarged cross-sectional view on line 5—5 of FIG. 1.

Referring now to the drawing in greater detail, the reference numeral 10 represents a flexible statue according to the present invention, which is comprised of a bendable wire frame 11 embedded inside a flexible rubber body 12, and which is detachably mounted upon a pedestal or base 13.

The armature includes a first wire 14 which at each end is welded to a plate 15 forming a stiffener for the statue foot 16. The ends then extend upwardly through each leg 17 of the statue, at the upper end of the legs they are looped together as shown at 18 and then together extend through the torso 19 and into the head 20 where the wire center is bent into a flat loop 21. A second wire extends transversely into each arm 23, a terminal end forming a loop 24 in each hand 25.

A metal tube 26 has a transverse opening 27 therethrough and through which the first wire extends. The second wire extends longitudinally through the tube, and the tube is thereafter crushed at opposite ends as shown at 28, so as to crimp against the second wire. As shown in FIG. 4, the second wire includes a series of zig zag bends so to form short legs therebetween that are all on a same flat plane so as to form a grid against opposite sides of which the tube is flattened. The tube forms the shoulders 29 of the statue.

A pair of threaded holes 30 in each plate 15 serves to receive mounting screws 31 extending upwardly through holes **31*a* in the base 13 and through a metal bar 32 on an underside thereof. The screw heads 33 are knurled so as to be easily turned by hand, and the base has an underside recess 34** for containing the screw heads in a hidden manner.

In use, the statue can be bent into any desired stance, such as for example in FIG. 1, having a stance of a baseball batter holding a bat 35, and in FIG. 2 having a stance of a baseball pitcher waring a baseball glove 36.

The present invention includes a set of clothing, such as pants 37, shirt 38, undershirt 39 and cap 40 of a baseball player. These are sewn from fabric so as to earily fit on the statue. The statue thus clothed can be displayed, and the stance thereof may be altered as wished, at any time.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A flexible statue, comprising in combination, a bendable wire frame, a contoured body of flexible material all around said frame, and a base upon which said frame is secured by removable screws; said flexible statue including a set of garments of fabric, as removable clothing for said statue, said frame being comprised of a pair of wires crossing at a junction within a tube, which at its opposite ends is flattened around a zig-zag bent portion of one of said wires; said base including a row of holes therethrough for selectively receiving said screws, said frame including a pair of plates having threaded openings for receiving said screws, a recess on an underside of said base, said screws extending upward from said recess, through said base, through said flexible material between said base and an underside of said plates and into said plate threaded openings.

* * * * *